United States Patent [19]

Myers et al.

[11] 4,140,232

[45] Feb. 20, 1979

[54] MOUNTING STRUCTURE FOR AN EARTH-WORKING MACHINE

[75] Inventors: Jimmy D. Myers, Morton, Ill.; Michael G. Mikutis, Taylor, Mich.

[73] Assignee: Caterpillar Tractor Co., Peoria, Ill.

[21] Appl. No.: 837,772

[22] Filed: Sep. 29, 1977

[51] Int. Cl.[2] ..... E02F 3/32

[52] U.S. Cl. ..... 214/138 C; 308/3 R

[58] Field of Search ..... 214/138 C; 308/3 R, 308/3 A; 104/248

[56] References Cited

U.S. PATENT DOCUMENTS

| | | | |
|---|---|---|---|
| 1,442,194 | 1/1923 | Thomas | 104/248 |
| 2,582,889 | 1/1952 | Sedgwick | 308/3 R |
| 3,117,685 | 1/1964 | Davis | 214/138 C |
| 3,215,282 | 11/1965 | Wiemann et al. | 214/138 C |
| 3,405,823 | 10/1968 | Williams | 214/138 C |
| 3,448,657 | 6/1969 | Huser et al. | 308/3 R |

FOREIGN PATENT DOCUMENTS

| | | | |
|---|---|---|---|
| 2006986 | 4/1969 | France | 214/138 C |

*Primary Examiner*—Albert J. Makay
*Assistant Examiner*—Ross Weaver
*Attorney, Agent, or Firm*—Wegner, Stellman, McCord, Wiles & Wood

[57] ABSTRACT

A tractor-mounted slide rail assembly for an earth-working machine. The assembly includes an upper and a lower vertically spaced rail, each rail having an upper and a lower outwardly extending flange forming an acute angle with a base portion. A carrier having flange-engaging lips mounted for slidable movement is secured to the upper and lower flanges of the upper and lower vertically spaced rails. A releasable clamp is mounted on the carrier for restraining slidable movement of the earthworking machine along the assembly. The flange-engaging lips on the inner flanges between the rails may be adjusted for improved carrier travel. A safety retaining hook is provided for engaging the assembly in the event the flange-engaging lips disengage.

10 Claims, 5 Drawing Figures

MOUNTING STRUCTURE FOR AN EARTH-WORKING MACHINE

BACKGROUND OF THE INVENTION

1. Field of the Invention

This invention relates generally to earth-working equipment and, more particularly, to an improved rail and mounting assembly for a tractor-mounted earth-working machine.

2. Description of the Prior Art

Earth-working machines, such as backhoes, mounted on a tractor are versatile and may be easily transported from jobsite to jobsite. A number of known earth-working machines have a frame assembly secured to the rear of the tractor or vehicle to provide lateral movement of the earth-working machine. For example, U.S. Pat. No. 3,788,674, issued Jan. 29, 1974, assigned to Caterpillar Tractor Co., the assignee hereof, shows a vertically spaced, parallel rail assembly for horizontal backhoe movement on the rear portion of a tractor. The backhoe can be locked or secured in a fixed position with respect to the tractor when it is moved to a selected or desired position. It is often desirable to employ a more simplified tractor-mounted rail and mounting structure for an earth-working machine which is adjustable and durable and which adequately clamps or secures the earth-working machine at a desired position along the rail.

SUMMARY OF THE INVENTION

The present invention is directed to overcoming one or more of the problems set forth above.

According to the present invention, an improved rail and mounting structure is provided, the rails of which are self-cleaning and economical as compared to the prior art fabricated box-type rails. Adjustable inner brackets facilitate assembly and the maintenance of appropriate mechanical clearances, and simply constructed bolt or hydraulically-actuated clamps retain the earth-working machine at a selected location.

An assembly of vertically spaced rails is secured to the rear portion of a tractor. The rails open outwardly and are received by a carrier on which the earth-working machine is mounted. The carrier moves laterally along the assembly and may be retained in one of an infinite number of selected positions along the rails. Each rail has a base and an upper and lower flange extending outwardly from the base forming an acute angle therewith. A flange-engaging structure on the carrier engages the flanges of the upper and lower rails. A clamping structure is mounted on the carrier to retain it laterally at a selected position. The clamping structure may be a bolt-actuated clamp or a hydraulically-actuated clamp. A safety hook is mounted on the carrier to retain the earth-working machine in the event that a flange-engaging structure on the carrier disengages the rails.

The present invention provides an improved rail and mounting structure that is simple and durable and provides a positive support for an earth-working machine. The clamps thereof slide freely when not engaged, yet tightly secure the earth-working machine to the tractor when actuated. The mounting structure on the carrier of the excavating machine provides appropriate adjustment of the carrier on the rails.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
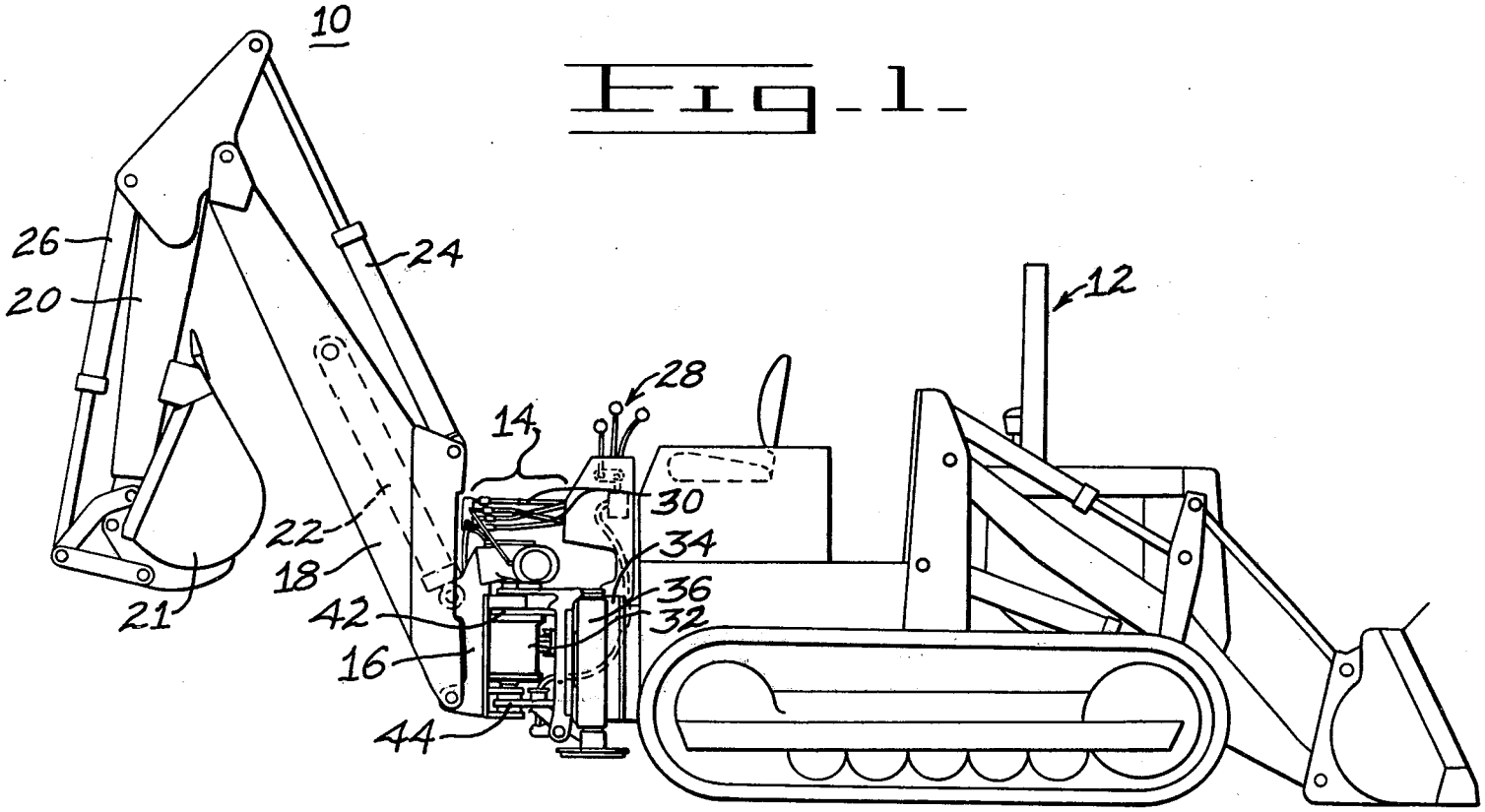
FIG. 1 is a side elevation of an earth-working machine mounted on a tractor by means of the mounting structure of the present invention.

Referring to FIG. 1, an earth-working machine, such as backhoe 10, is secured to a tractor 12 by the mounting structure, generally designated 14.

Earth-working machine 10 is adapted for lateral movement along the mounting structure 14 and for rotational movement around the carrier 40.

Boom 18 is pivotably mounted for rotational movement in a vertical plane about a pivot on the swing frame 16. A dipperstick 20, mounted for movement in a vertical plane about the other end of boom 18, carries a bucket 21. Hydraulic cylinders 22, 24 and 26, operatively controlled by control levers 28, selectively position the boom, dipperstick and bucket. Hydraulic conduits 30 provide passageways for hydraulic fluid (pressurized by a pump, not shown) being directed through control valves 28 to the respective hydraulic cylinders 22, 24 and 26 and swing motor 32.

Figure 2:
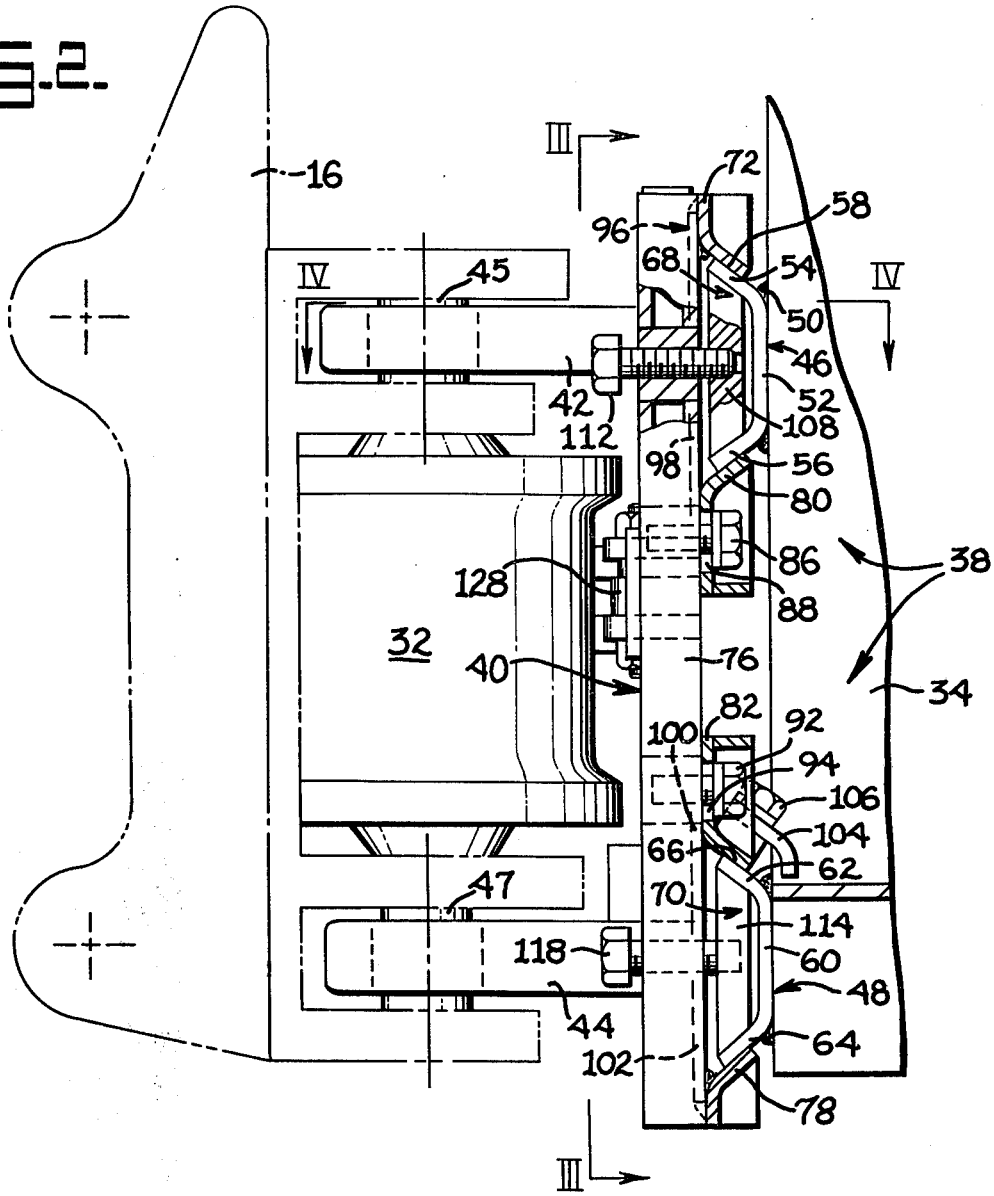
FIG. 2 is a vertical cross-sectional view of the mounting structure.

Mounting structure 14 includes a frame or base 34 which extends across and is secured to the rear of tractor 12. Hydraulically operated stabilization jacks, such as jacks 36, are attached to the outer ends of the frame 34 and operate in the well known manner to stabilize the tractor 12 during operation of the earthmoving machine 10. In FIG. 2, a vertically spaced horizontally extending rail assembly 38, to be explained in greater detail below, is secured to frame 34. A detachably mounted carrier 40 is secured to rail assembly 38 for lateral motion along the frame 34. The carrier has two outwardly extending brackets 42 and 44 carrying vertical pins 45 and 47 on which swing frame 16 pivots.

Figure 4:
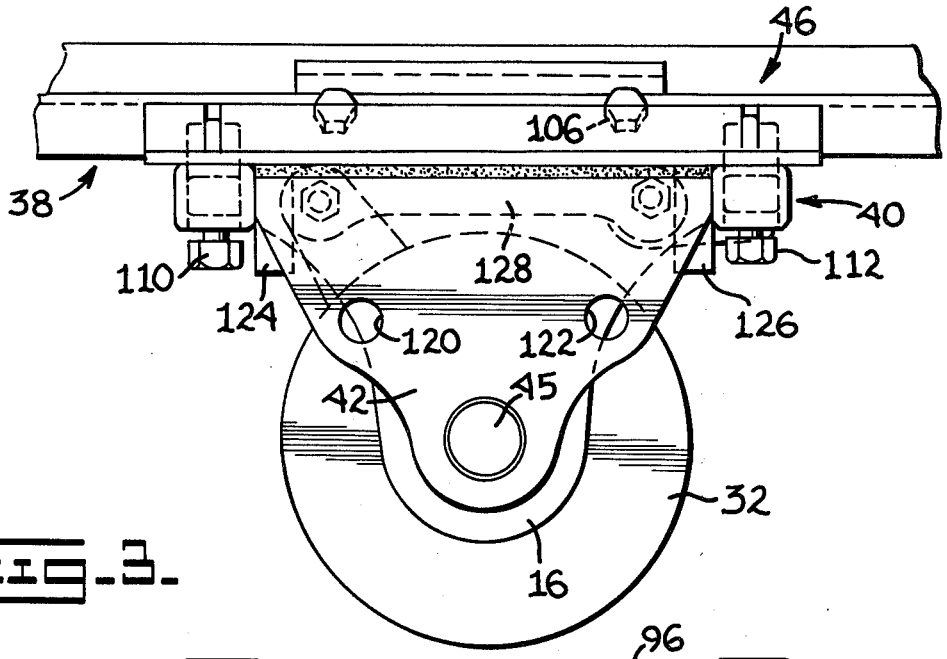
FIG. 4 is a horizontal sectional view taken generally along the line 4—4 of FIG. 2.
Figure 3:
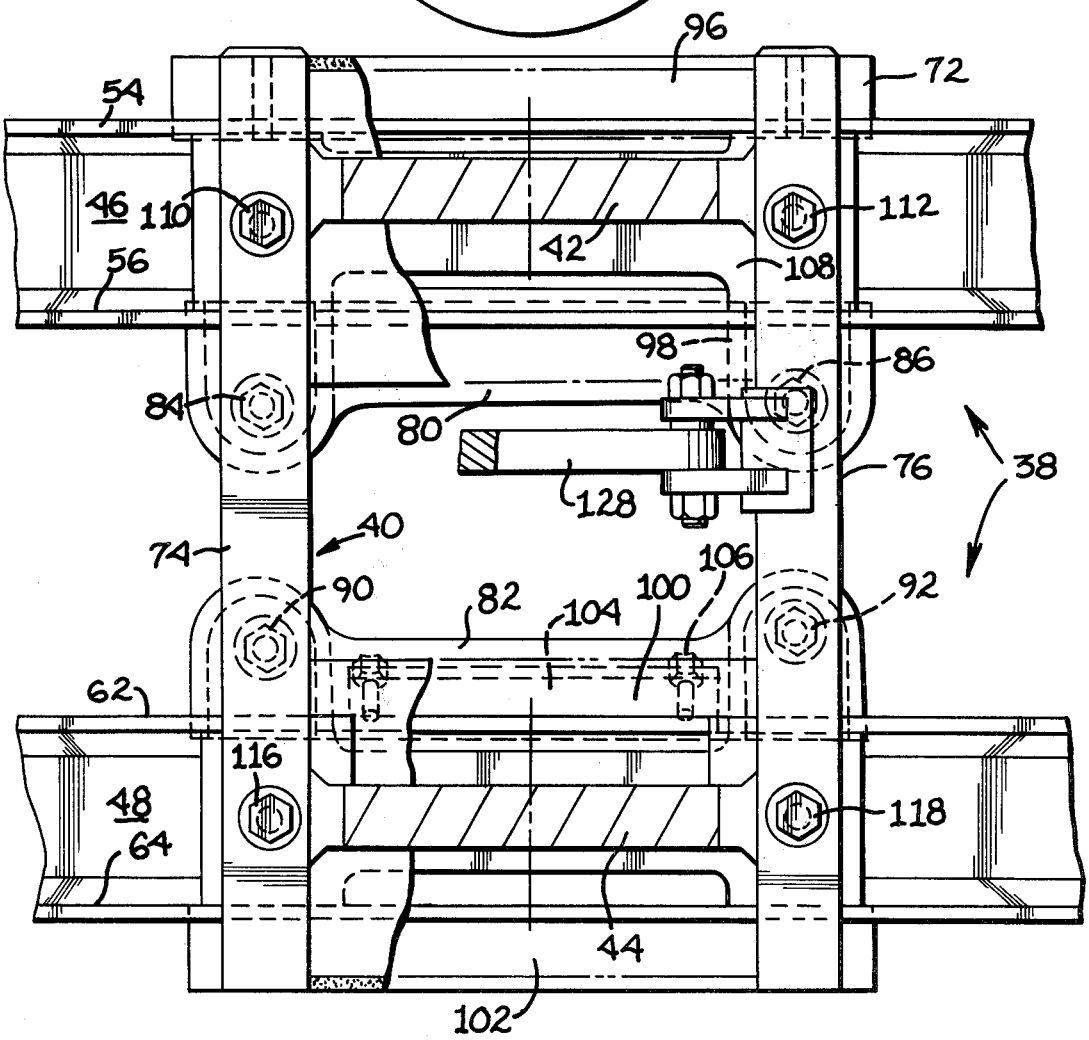
FIG. 3 is a horizontal sectional view taken through the line 3—3 of FIG. 2.

Referring to FIGS. 2-4, the improved mounting structure 14 and rail assembly 38 will now be described. Rail assembly 38 includes an upper rail 46 and a lower rail 48, each of which is secured to the frame 34 by welding, such as by weld bead 50 along the length of rail 46. Upper rail 46 includes a base section 52, an upper flange 54 and a lower flange 56, each extending outwardly from base 52. The upper and lower flanges 54 and 56 form an acute angle with base 52, and hence frame 34. Upper flange 54 has a bearing surface 58 which supports carrier 40. Lower rail 48 may be similarly constructed, having a base 60, an outwardly extending upper flange 62, and an outwardly extending lower flange 64. Upper flange 62 has a bearing surface 66 supporting carrier 40.

The base 52, upper flange 54 and lower flange 56 of upper rail 46 form an outwardly opening channel 68.

Similarly, base 60, upper flange 62 and lower flange 64 of lower rail 48 form an outwardly opening channel 70.

Carrier 40 has a downwardly extending upper lip 72 which engages bearing surface 58 of upper flange 54 of upper rail 46. Upper lip 72 is secured to vertically extending beams 74 and 76 at each end by welding or other suitable method. Secured to the lower ends of vertically extending beams 74 and 76 is an upwardly extending lower lip 78. Vertically adjustable upper lip 80 engages lower flange 56 of upper bracket 46. Similarly, a vertically adjustable lower inner lip 82 engages bearing surface 66 of upper flange 62 on lower rail 48. Inner lips 80 and 82 are adjustable to allow the quick adjustment of travel of carrier 40 along rail assembly 38. Upper inner lip 80 is secured to vertically extending beams 74 and 76 by nut and bolt assemblies 84 and 86. Slots 88 provide for the vertical adjustment of upper inner lip 80. Similarly, nut and bolt assemblies 90 and 92 secure the lower inner lip 82 to vertically extending beams 74 and 76. Slots 94 provide for the vertical adjustment of inner lip 82.

A plurality of stabilizing plates 96, 98, 100 and 102 may be secured to beams 74 and 76 to maintain carrier 40 rigidly mounted.

A safety retaining hook 104 may be secured to lower inner lip 82 by bolts 106. Safety retaining hook 104 engages the upper flange 62 of the lower rail 48 when lower inner lip 82 disengages from upper flange 62.

Carrier 40 is adapted for infinitely adjustable slidable movement along rail assembly 38. It is desirable, however, to secure the carrier 40 against lateral movement at the desired location. To provide such lateral restraint, upper rail 46 and lower rail 48 are provided with releasable clamps. Specifically, upper rail 46 with outwardly opening channel 68 receives a wedge-shaped locking structure 108 which is moved into and out of engagement with upper flange 54 and lower flange 56 by adjustment bolts 110 and 112. Adjustment bolts 110 and 112 extend through beams 74 and 76, respectively. The tightening of adjustment bolts 110 and 112 urges the wedge-shaped locking structure 108 against upper flanges 54 and 56, thereby engaging upper lip 72 and upper inner lip 80 with flanges 58 and 56, respectively. Similarly, lower rail 48 with outwardly opening channel 70 is provided with wedge-shaped locking structure 114 which moves into and out of engagement with lower rail 48 by adjustment bolts 116 and 118 which extend through vertically extending beams 76 and 78. The outer surfaces of wedge-shaped locking structures 108 and 114 generally conform to the shape of the outwardly opening channels 68 and 70 and, when engaged, restrain lateral movement of carrier 40. Also, locking structures 108 and 114 provide support for the upper and lower flanges.

Brackets 42 and 44 are rigidly attached to beams 74 and 76 and may be provided with pin-receiving holes 120 and 122 for securing the earth-working machine from rotation during travel. Carrier 40 may include stops 124 and 126 to restrict movement about the vertical axis of the swing frame pivot. Carrier 40 may also include a rotary lock-type structure 128 for fluid motors, the mounting of which forms no part of the present invention.

Figure 5:
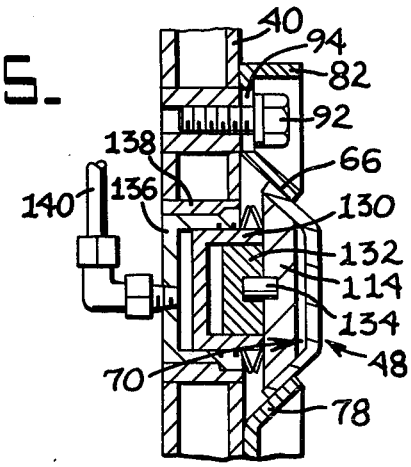
FIG. 5 is a horizontal sectional view of another form of hydraulically-operated, clamping structure embodying the invention.

Referring to FIG. 5, an alternate type of clamping structure is shown. Therein, a hydraulically-actuated piston 130 has an annular opening which receives a center slug 132 which carries a pin 134. Pin 134 positions slug 132 and transfers the shear load to wedge-shaped locking structure 114. A hydraulic cylinder 136 is suitably mounted in an annular bracket 138 secured to carrier 140. A hydraulic conduit 140 leads back to the console to be operated by control levers 28. The hydraulically-actuated clamp may be provided to control clamping motion, not only on the lower rail 48, but on the upper rail 46 as well.

The embodiments of the invention in which an exclusive property or privilege is claimed are defined as follows:

1. In an assembly of an earth-working machine and a vehicle, an improved mounting structure for adjustably mounting an earth-working machine to said vehicle comprising:

a lower rail having a base secured to the vehicle, said base having an upper flange and a lower flange extending outwardly at an acute angle thereto, a first channel being formed between said flanges on said lower rail;

an upper rail having a base secured to the vehicle in vertically spaced relationship to the lower rail, said upper rail having an upper flange and a lower flange extending outwardly at an acute angle thereto, a second channel being formed between said flanges on said upper rail;

a carrier mounted to the earth-working machine and having flange-engaging means for engaging said upper and lower flanges of said upper and lower rails; and clamping means mounted on the carrier engaging said lower and upper rails within said first and second channels respectively, for releasably clamping said flange-engaging means against the upper and lower flanges of said upper and lower rails, to restrain slidable movement of the earth-working machine along the mounting structure.

2. The improved rail and mounting means of claim 1 wherein the flange-engaging means includes:

an upper lip engaging the upper flange of the upper rail;

a lower lip engaging the lower flange of the lower rail; and means connecting the upper lip and the lower lip.

3. The improved rail and mounting means of claim 1 wherein the flange-engaging means includes:

an upper lip engaging the upper flange of the upper rail;

a lower lip engaging the lower flange of the lower rail;

means connecting the upper lip and the lower lip;

an upper inner lip engaging the lower flange of the upper rail mounted on said connecting means; and a lower inner lip engaging the upper flange of the lower rail mounted on said connecting means.

4. The improved rail and mounting means of claim 3 further including:

a safety retaining lip secured to the carrier above the lower inner lip for engaging the upper flange of the lower rail if the lower inner lip disengages the upper flange of the lower rail.

5. The improved rail and mounting means of claim 3 wherein the connecting means includes:

two horizontally spaced beams each having an upper and a lower end, the upper ends secured to the upper lip and the lower ends secured to the lower lip.

6. The improved rail and mounting means of claim 5 further including a plurality of vertically extending stabilizer plates connected to the two horizontally spaced beams at each end.

7. The improved rail and mounting means of claim 3 wherein the upper inner lip and the lower inner lip are vertically adjustable with respect to the upper and lower rails.

8. In an assembly of an earth-working machine and a vehicle, an improved mounting structure for adjustably mounting an earth-working machine to said vehicle comprising:

a lower rail having a base secured to the vehicle, said base having an upper flange and a lower flange extending outwardly at an acute angle thereto and forming an outwardly opening channel with respect to said base;

an upper rail having a base secured to the vehicle in vertically spaced relationship to the lower rail, said upper rail having an upper flange and a lower flange extending outwardly at an acute angle thereto and forming an outwardly opening channel with respect to said base;

a carrier mounted to the earth-working machine and having flange-engaging means for engaging said upper and lower flanges of said upper and lower rails;

wedge-shaped clamping means having a surface generally conforming to the shape of the channels, said clamping means mounted in the channels at the upper and lower rails for engaging the upper and lower flanges of the upper and lower rails; and means for moving the clamping means into and out of engagement with said upper and lower flanges of the upper and lower rails within said channels thereof.

9. The improved rail and mounting means of claim 8 wherein the means for moving the clamping means into and out of engagement includes:

hydraulically-actuated pistons and cylinders secured to the carrier.

10. The improved rail and mounting means of claim 8 wherein the means for moving the clamping means into and out of engagement includes:

an adjustable bolt secured to the carrier.

* * * * *